US007509789B2

(12) United States Patent
Scholtes et al.

(10) Patent No.: US 7,509,789 B2
(45) Date of Patent: Mar. 31, 2009

(54) TRAY ERECTOR

(75) Inventors: William John Scholtes, Pascoe Vale South (AU); Trevor Henry Craven, South Yarra (AU)

(73) Assignee: Visy R & D Pty Ltd, Melbourne, Victoria (AU)

( * ) Notice: Subject to any disclaimer, the term of this patent is extended or adjusted under 35 U.S.C. 154(b) by 161 days.

(21) Appl. No.: 11/200,841

(22) Filed: Aug. 10, 2005

(65) Prior Publication Data

US 2007/0037682 A1 Feb. 15, 2007

(51) Int. Cl.
*B65B 43/08* (2006.01)

(52) U.S. Cl. ..... 53/563; 493/163

(58) Field of Classification Search ..... 53/150, 53/151, 128, 141, 142, 162, 183, 80, 580, 53/563, 586, 575, 383.1, 382.1, 387.1–2, 53/389.4–5; 493/80, 163; 83/180
See application file for complete search history.

(56) References Cited

U.S. PATENT DOCUMENTS

| | | | | | |
|---|---|---|---|---|---|
| 1,283,066 | A | * | 10/1918 | Burke | 53/377.2 |
| 3,461,642 | A | * | 8/1969 | Langen et al. | 53/456 |
| 3,800,677 | A | * | 4/1974 | Jones et al. | 493/6 |
| 3,882,655 | A | | 5/1975 | Monaghan | |
| 3,901,133 | A | * | 8/1975 | Hall et al. | 493/128 |
| 4,015,403 | A | * | 4/1977 | Langen | 53/575 |
| 4,617,046 | A | * | 10/1986 | Hals | 65/134.4 |
| 4,693,404 | A | * | 9/1987 | Wayman et al. | 225/103 |
| 5,161,938 | A | * | 11/1992 | Traegaardh | 414/795.8 |
| 5,699,708 | A | * | 12/1997 | Deni et al. | 83/180 |
| 5,807,223 | A | * | 9/1998 | Holton | 493/84 |
| 6,186,931 | B1 | | 2/2001 | Calvert et al. | |
| 6,357,623 | B1 | * | 3/2002 | Biehl et al. | 221/210 |
| 6,364,821 | B1 | * | 4/2002 | Mariotti et al. | 493/331 |
| 6,629,403 | B1 | * | 10/2003 | Tisma | 53/502 |
| 2004/0050228 | A1 | * | 3/2004 | Borzym | 83/178 |
| 2007/0001363 | A1 | * | 1/2007 | Flagg et al. | 271/3.01 |

* cited by examiner

*Primary Examiner*—Rinaldi I. Rada
*Assistant Examiner*—John Paradiso
(74) *Attorney, Agent, or Firm*—Rothwell, Figg, Ernst & Manbeck, P.C.

(57) ABSTRACT

A machine (1) for erecting open topped cartons or trays from a substantially flat blank of varying height and footprint dimensions, comprising a magazine 3 adapted to support a supply of flat blanks of predetermined dimensions, a vacuum transfer means for transferring blanks one at a time from the supply to adjustable transfer rails (4)(62)(63) for transferring the blanks to a tray forming section 5, means G for applying glue to the blanks at predetermined locations, the tray forming section 5 including a variable well 6 defined by wall means 11 to 18 which are moveable in two directions to adjust the size of the well and a mandrel 7 having portions 40 to 43 which are moveable in two directions to adjust the size of the mandrel, and a cylinder 45 for pushing the mandrel into the well to fold the blank into a tray, the well being open at the bottom to allow the formed tray to be pushed through the well and onto a conveyor 8 for conveying the formed tray away from the machine.

8 Claims, 8 Drawing Sheets

TRAY ERECTOR

FIELD OF THE INVENTION

This invention relates to an apparatus for erecting open-topped containers or trays.

BACKGROUND OF THE INVENTION

At the present time, tray erectors having a well of fixed dimensions and a mandrel of fixed dimensions adapted to fit within the well, are used to erect corrugated cardboard or other packaging material trays or open topped cartons from a flat blank. The blank is positioned over the well and mandrel pushes on the blank in the base region to force the sides of the blank up as the blank is pushed into the well. Whilst this arrangement works well for trays of one fixed footprint size, if a tray of a different size is required, the components from which the well and mandrel are constructed must be repositioned or replaced to suit the dimensions of the new tray. Alternatively, more than one machine will be required. This adds to the cost of equipment or to the cost of operating the machine to allow for the erection of trays of various footprint dimensions.

Other forms of tray erector machines are known in the patent literature. Examples of such machines will be found in U.S. Pat. No. 3,882,655 (Monaghan) and U.S. Pat. No. 6,186,931 (Calvert, et al). It will be noted that the machines described in these United States patents are complex and do not allow for the erection of trays using a well/mandrel combination.

SUMMARY OF THE INVENTION AND OBJECT

It is an object of the present invention to provide an apparatus or machine for erecting open topped cartons or trays of varying dimensions.

The invention provides a machine for erecting open topped cartons or trays from substantially flat blanks, comprising a magazine for storing a supply of flat blanks of predetermined dimensions, means for delivering a blank from the magazine to a tray forming section, said tray forming section including a well defined by wall elements which are movable in two directions to adjust the size of the well, a mandrel having portions which are movable in two directions to adjust the size of the mandrel, and drive means for pushing the mandrel into the well to fold the blank into a tray.

In one form, the wall portions defining the well and the portions defining the mandrel include connected wall elements which define the corners of the well and the corners of the mandrel, said elements being moveable towards and away from each other to vary the dimensions of the well and the mandrel to suit blanks of various dimensions.

The wall elements defining the well include plate members assembled to define a corner of the well, the plate members having upper edges which are rolled outwardly to allow the blank to be pushed into the well by the mandrel, the wall elements defining the mandrel comprising plates formed from or coated with low friction material such as nylon.

The well corner elements may be adjusted by screw driven means while the mandrel wall elements can be adjusted by pneumatic cylinder means.

The means for delivering blanks to the tray forming section may include a pair of blanks support rails which are adjustable towards and away from each other to suit blanks of various dimensions.

The means for delivering blanks may include blank kickers for moving the blanks from the magazine, pinch rolls for moving the blanks towards the tray forming section and blank kickers for moving the blanks to the tray forming section.

The magazine may include a support for a stack of blanks which is vertically moveable towards a vacuum transfer means which transfers blanks one at a time from the stack to the means for delivering blanks.

The machine may further including blank end stops which are adjustable in position to ensure that blanks of various sizes are correctly positioned over the well.

Other features of an embodiment of the invention will be found in the description below.

BRIEF DESCRIPTION OF THE DRAWINGS

In order that the invention may be more readily understood, one embodiment of the invention will now be described with reference to the accompanying drawings in which.

DESCRIPTION OF EMBODIMENT

Figure 1:
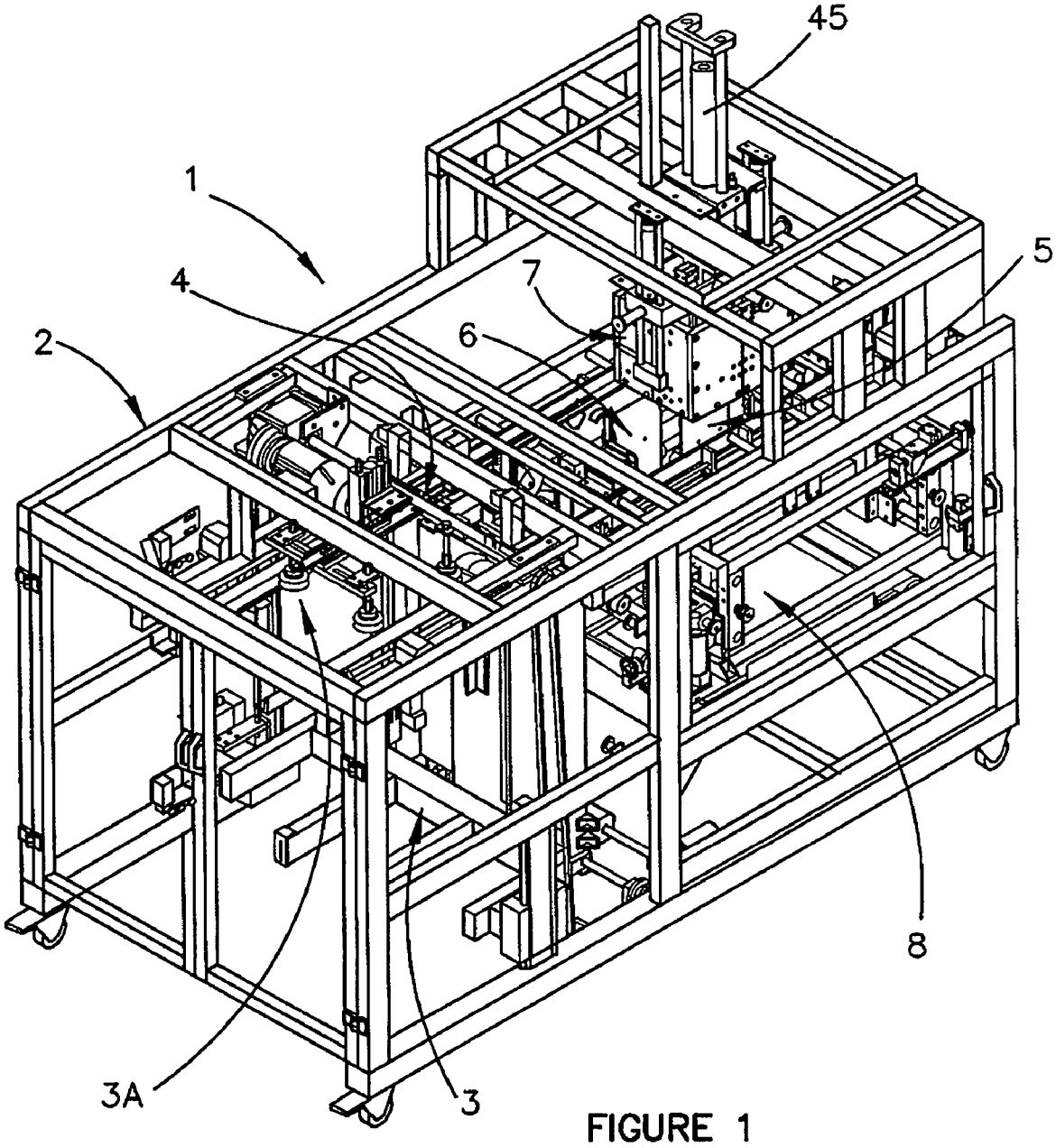
FIG. 1 is a "skeletal" isometric view of a machine embodying the invention.
Figure 2:
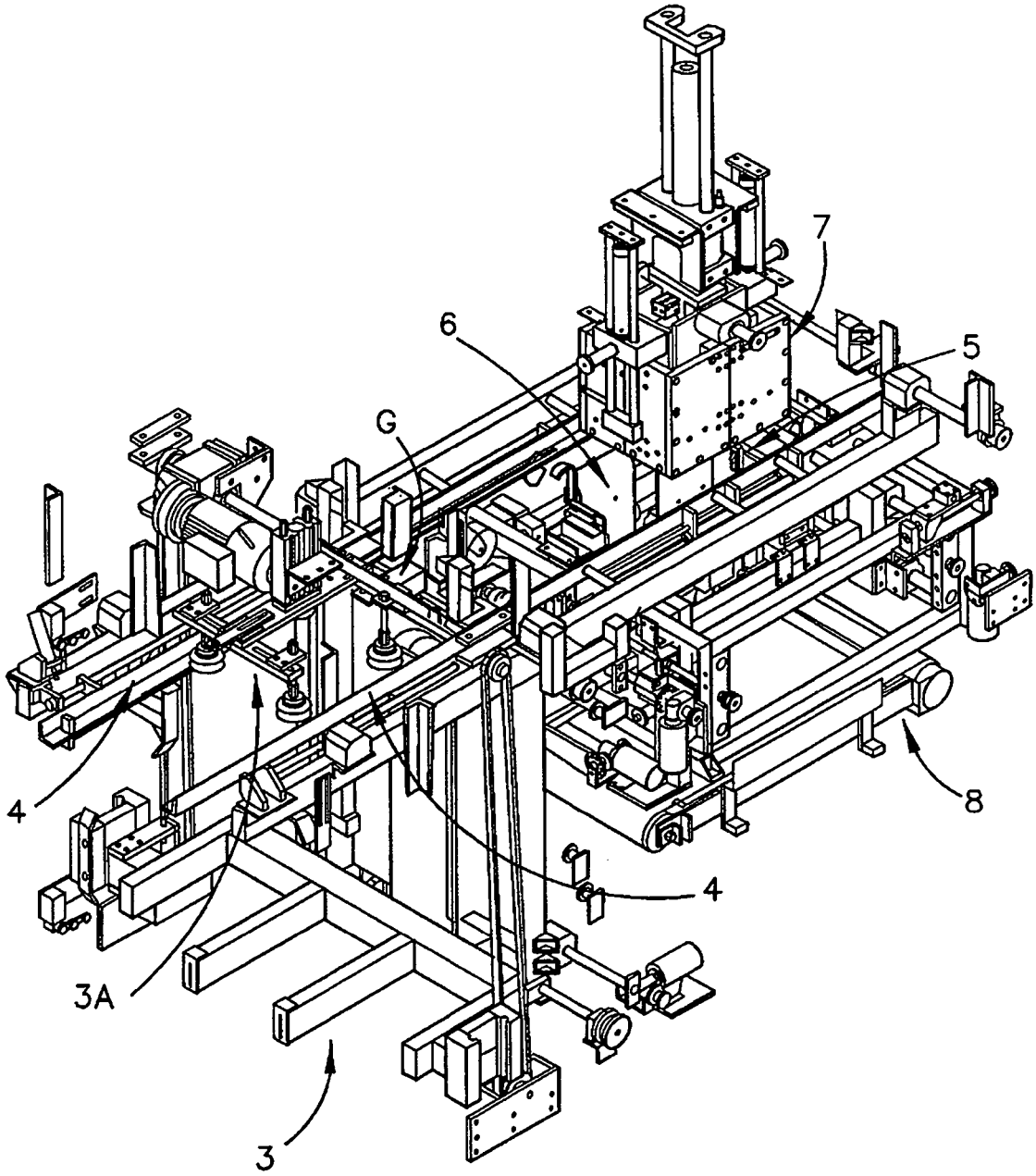
FIG. 2 is a similar isometric view of the machine with the outer supporting frame removed.

Referring to FIGS. 1 and 2 of the drawings, the variable tray erector 1 embodying the invention includes an outer frame 2 enclosing a magazine section 3 and a blank pick-up mechanism 3*a* (FIG. 8), a variable blank transfer rail section 4 (FIG. 9), a glue applicator section G, a tray forming section 5 (FIG. 3), comprising a size variable forming well (FIGS. 3, 4 and 5) and a size variable mandrel 7 (FIGS. 3, 6 and 7), and a conveyor 8 for removing the formed trays from under the variable well 6.

Referring to FIGS. 3 to 7, since the tray erector machine 1 is required to erect trays of varying height and footprint, the machine has an adjustable forming well 6, adjustable transfer rails 4 and a fully adjustable mandrel 7, which is shown in greater in FIGS. 3 to 7.

Figure 3:
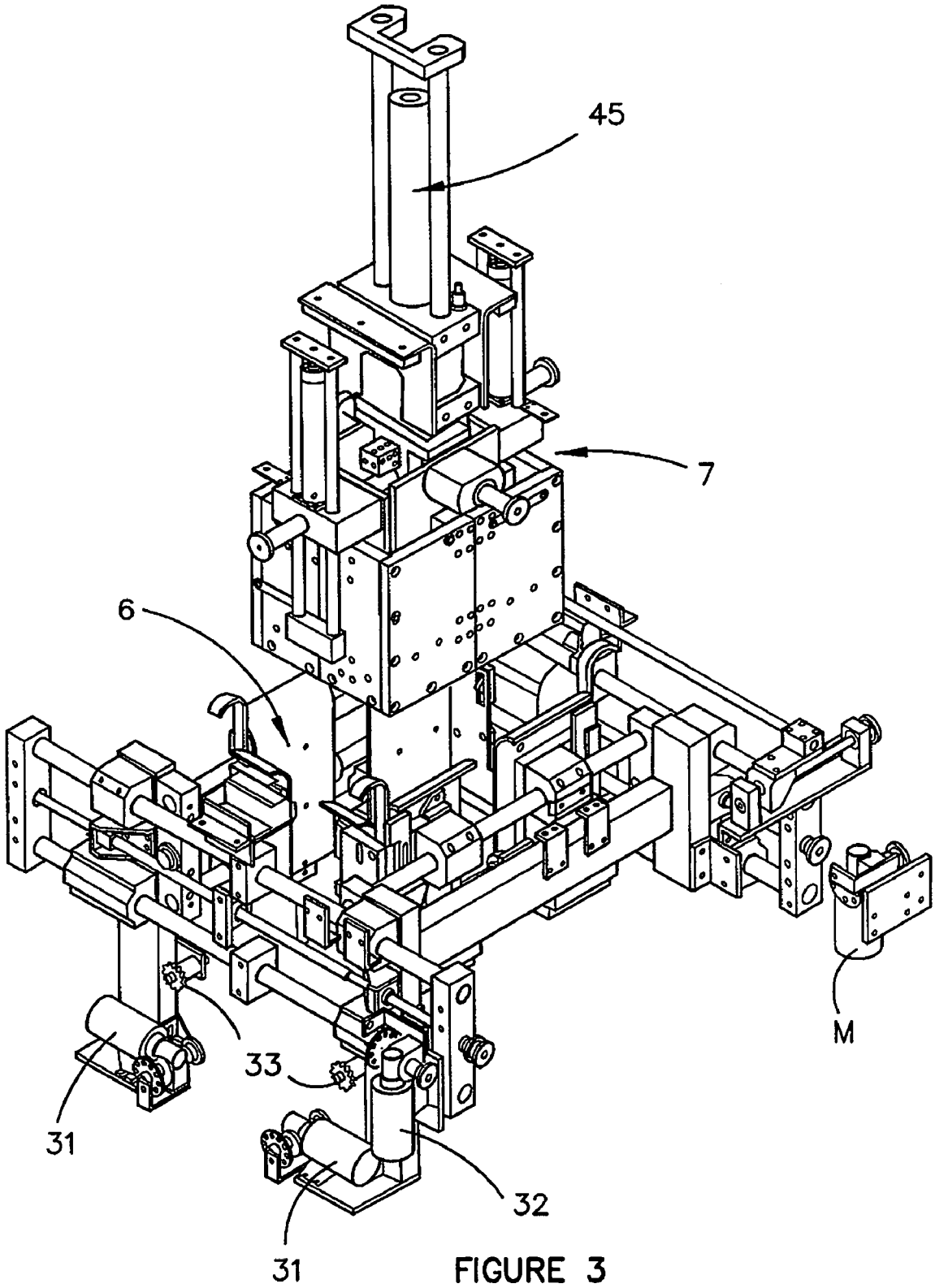
FIG. 3 is an isometric view of the forming section of the machine.
Figure 4:
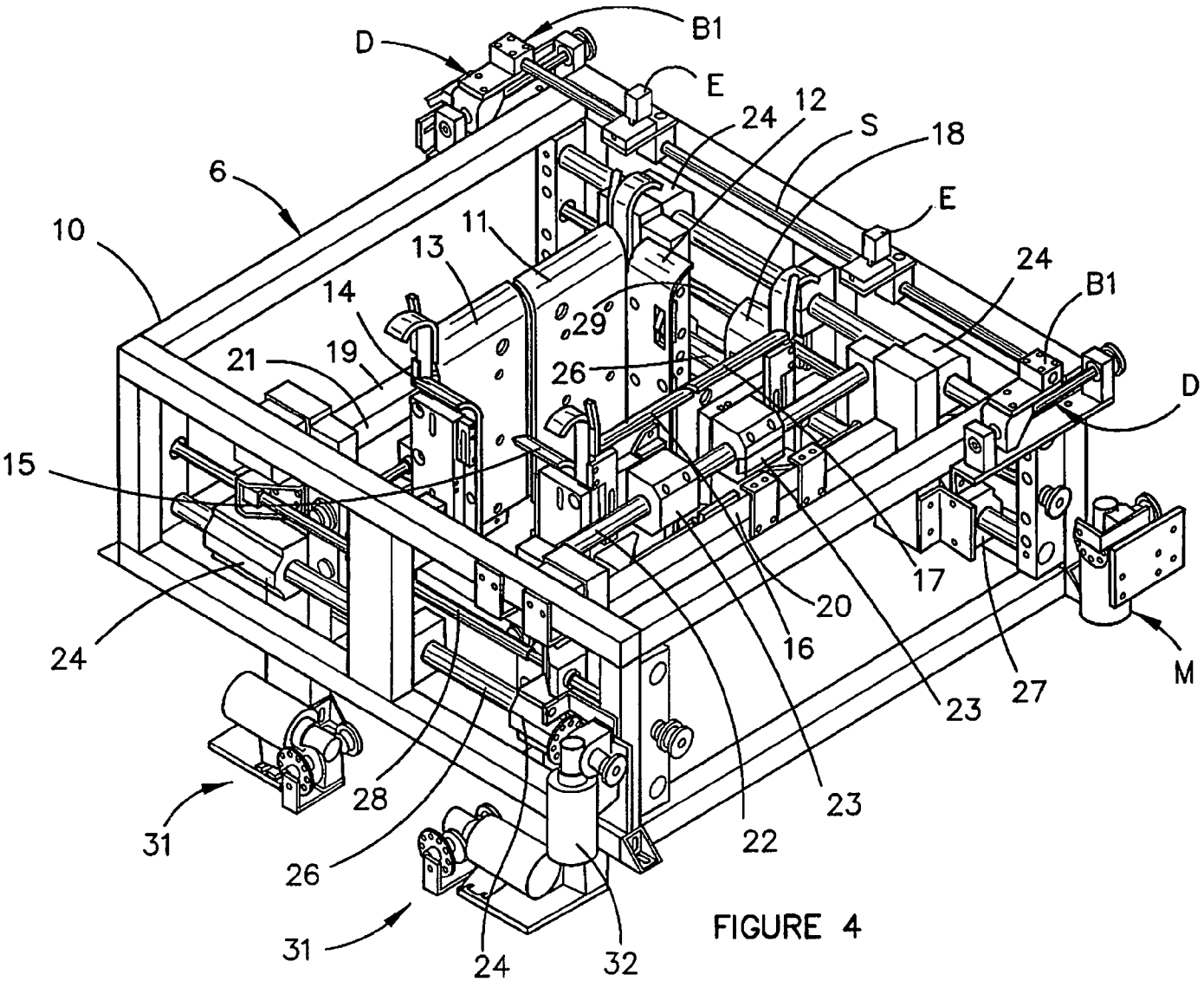
FIG. 4 is an isometric view of the variable well of the forming section.
Figure 5:
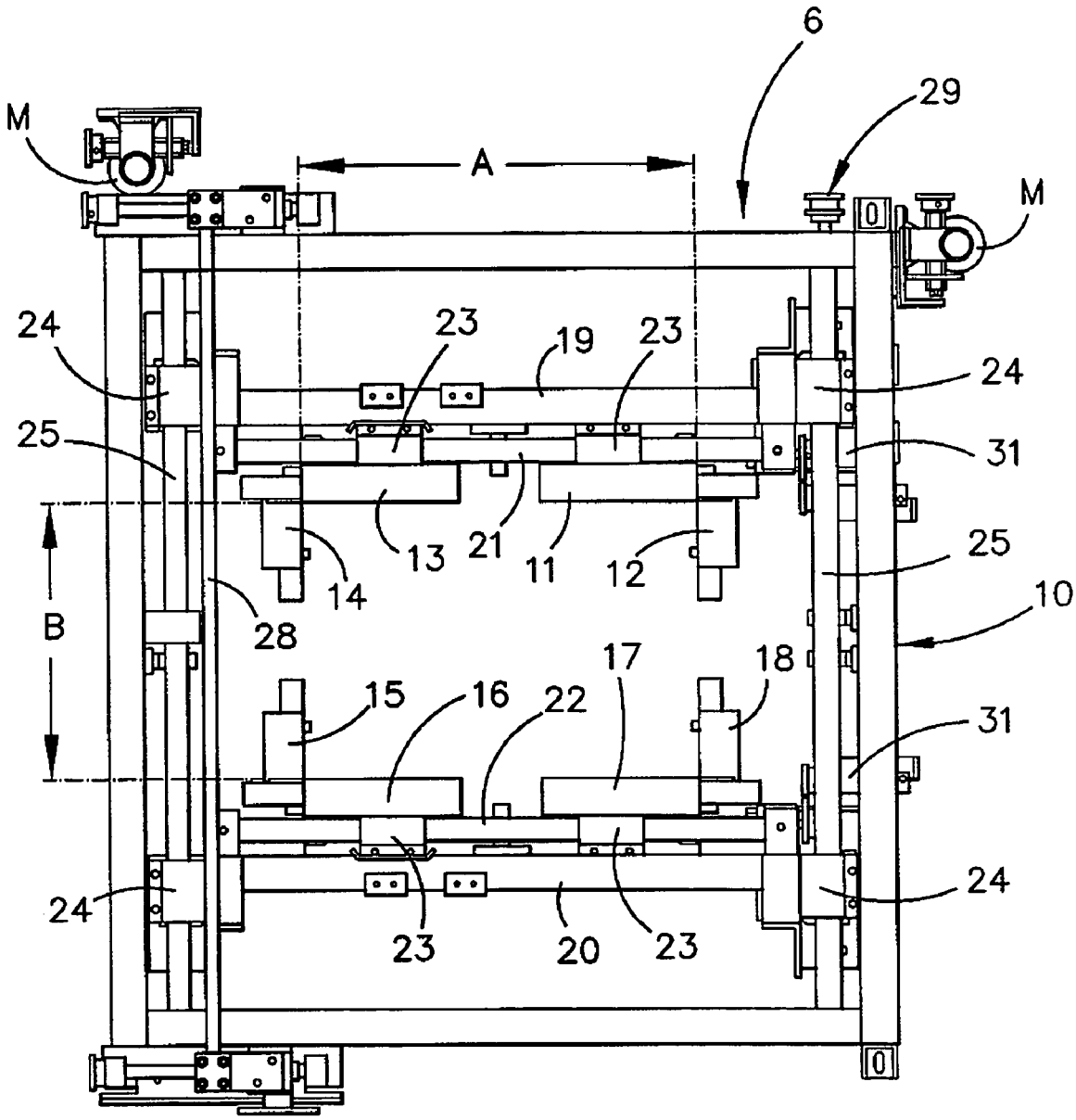
FIG. 5 is plan view of the well of FIG. 4.

Referring to FIGS. 3, 4 and 5, the well 6 includes a supporting frame 10 within which are positioned well corner defining assemblies comprising pairs of plates 11,12; 13,14; 15,16 and 17,18, carried by cross members 19 and 20 which carry pairs of support tubes 21 and 22 on which all corner defining assemblies 11 to 18 are mounted for movement towards and away from each other (arrows A) via bearing blocks 23. The cross members 19,10 are mounted via bearing blocks 24 on pairs of support tubes 25,26 for movement towards and away from each other (arrows B). The top edges of the plates 11 to 18 are outwardly rolled as shown to allow the blank (not shown) to be pushed into the well 6 in use of the machine 1.

To ensure that the blanks are correctly positioned over the well 6, blank end stops E are mounted on a cross shaft S carried by mounting blocks B on an adjustable screw drive D driven by motor M to position the end stops E appropriately for the blank size input into the machine controller. In addition, one-way dogs 66 (FIG. 9) prevent backward movement of the blanks to ensure that he blank is correctly positioned over the well 6.

The size adjustment of the well 6 by movement of the corner defining assemblies 11 to 18 is achieved by a screw driven ball nut drives 28, 29, and a drive not visible, driven by well size change motor pair 31 and motor 32. The motor pair 31 controls the well length on each side and the motor 32 changes the width of the well via driving chains (not shown) engaging sprockets 33.

To prevent mechanical damage to the various drives, end of limit travel switches (not shown) are mounted at both ends on each screw drive. The feedback for correct positioning is achieved by a proximity switch sensing an encoding disc mounted on the gearbox output shaft (not shown).

The well size and the blank end stop position may be adjusted automatically to suit a multiplicity of tray footprint sizes, and in this regard, the size adjusting motors are controlled by a programmable software associated with the control system (not shown) for the machine.

Figure 6:
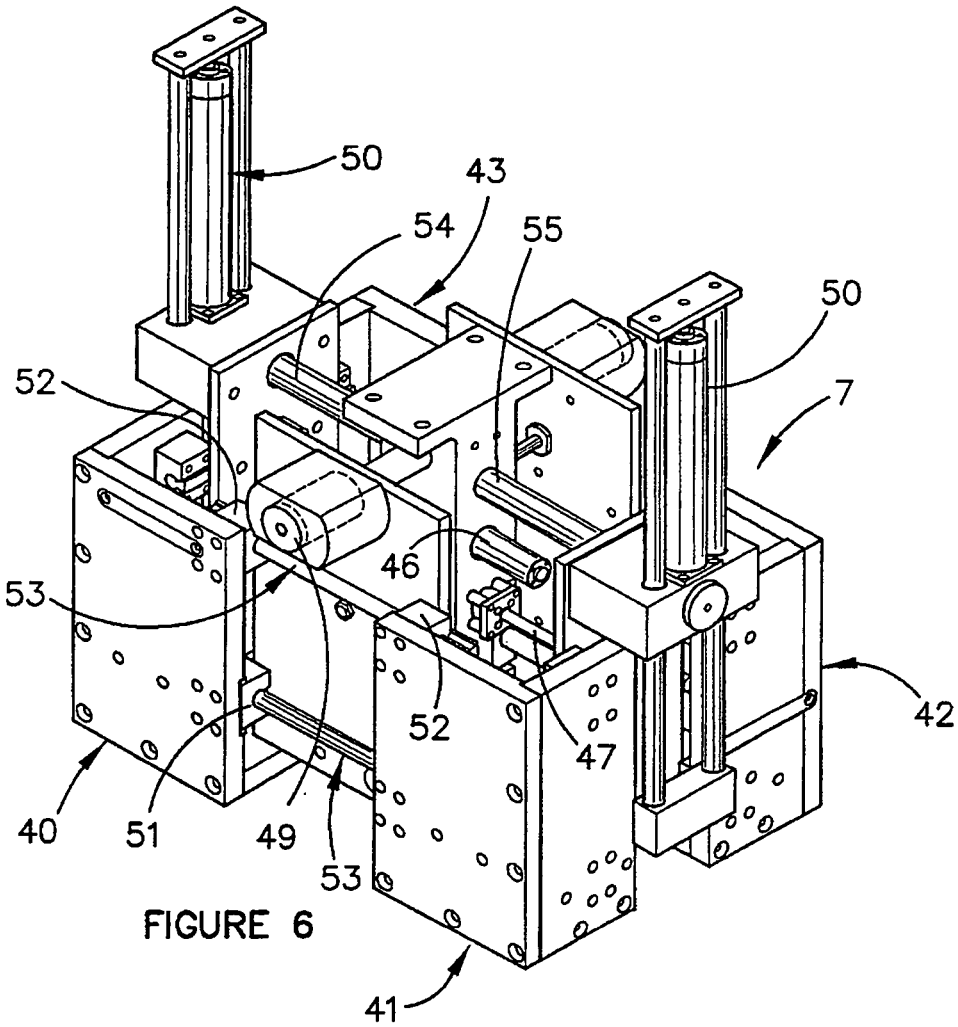
FIG. 6 is an isometric view of the variable mandrel of the forming section.
Figure 7:
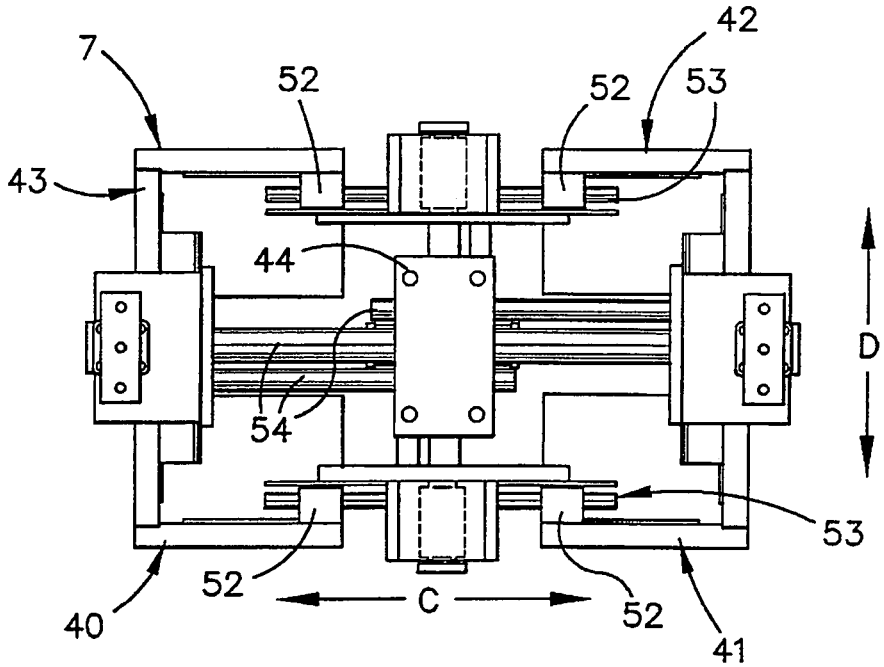
FIG. 7 is a plan view of the mandrel of FIG. 6.

Referring to FIGS. 3, 6 and 7, the variable mandrel 7 has four corner defining assemblies 40, 41, 42 and 43 made from flat plates of nylon or similar low friction material, or any suitable material coated with a low friction coating. The assemblies 40 to 43 are supported by a central column 44 which is connected to a mandrel cylinder 45 for movement of the mandrel 7 into and out of the variable well 6. The footprint of the mandrel 7 is controlled by four centrally mounted pneumatic positioning cylinders 46 to 49 which move the assemblies 40 to 43 in the direction of the arrows C and D (FIG. 7). The assemblies are carried abutments 52 engaging guide tracks 53, together with shafts 54 engaging bearing openings 55 in the column 44. The mandrel structure also carries blank squaring cylinders 50 which operate to ensure that the blank is square over the well 6 before the mandrel is operated.

When a size change is required, the well 6 is automatically extended to its outermost limits. When at this position, the mandrel 7 is retracted to its smallest size and extended down into the well 6. The well 6 is then driven inwards to the inner dimensions of the tray size which has been put into the control system. The mandrel 7 is then expanded outwardly, at which point proximity switches (not shown) detect contact of the end and sides of the mandrel 7 against the well 6, at which time the mandrel drives are locked and the mandrel 7 is set at the correct footprint dimensions. At this time, the well 6 is driven outwardly to enable the tray blank to fold up in the well 6 as the mandrel 7 pushes the blank into the well 6.

Figure 8:
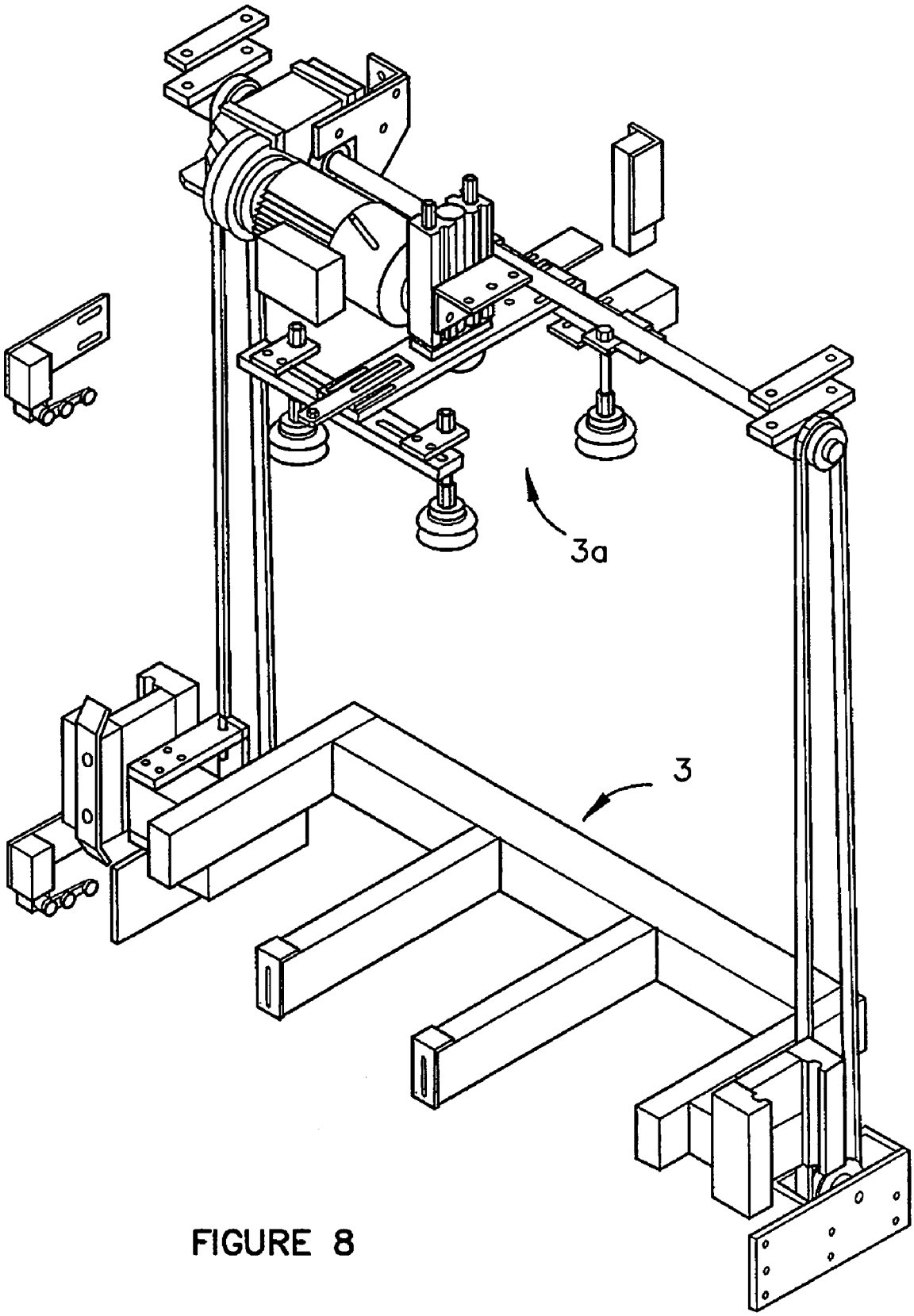
FIG. 8 is an isometric view of the magazine section and blank pick-up mechanisms.

Referring now to FIG. 8 of the drawings, the magazine section 3 and vacuum pick-up 3*a* will be seen to include a chain driven hoist arrangement, for raising the blanks supported by the magazine 3 to a position within reach of the vacuum pick-up 3*a*. The system incrementally lifts the blanks to a point where a photo-electric eye (not shown) detects the top of the stack and stops the lift mechanism. As blanks are removed and fed through the machine, the magazine lift raises to keep the blanks available to the vacuum lift mechanism 3*a*. When the magazine is empty, the sensor detects that there are no further blanks available and the machine will automatically lower to the bottom position ready for refilling.

Figure 9:
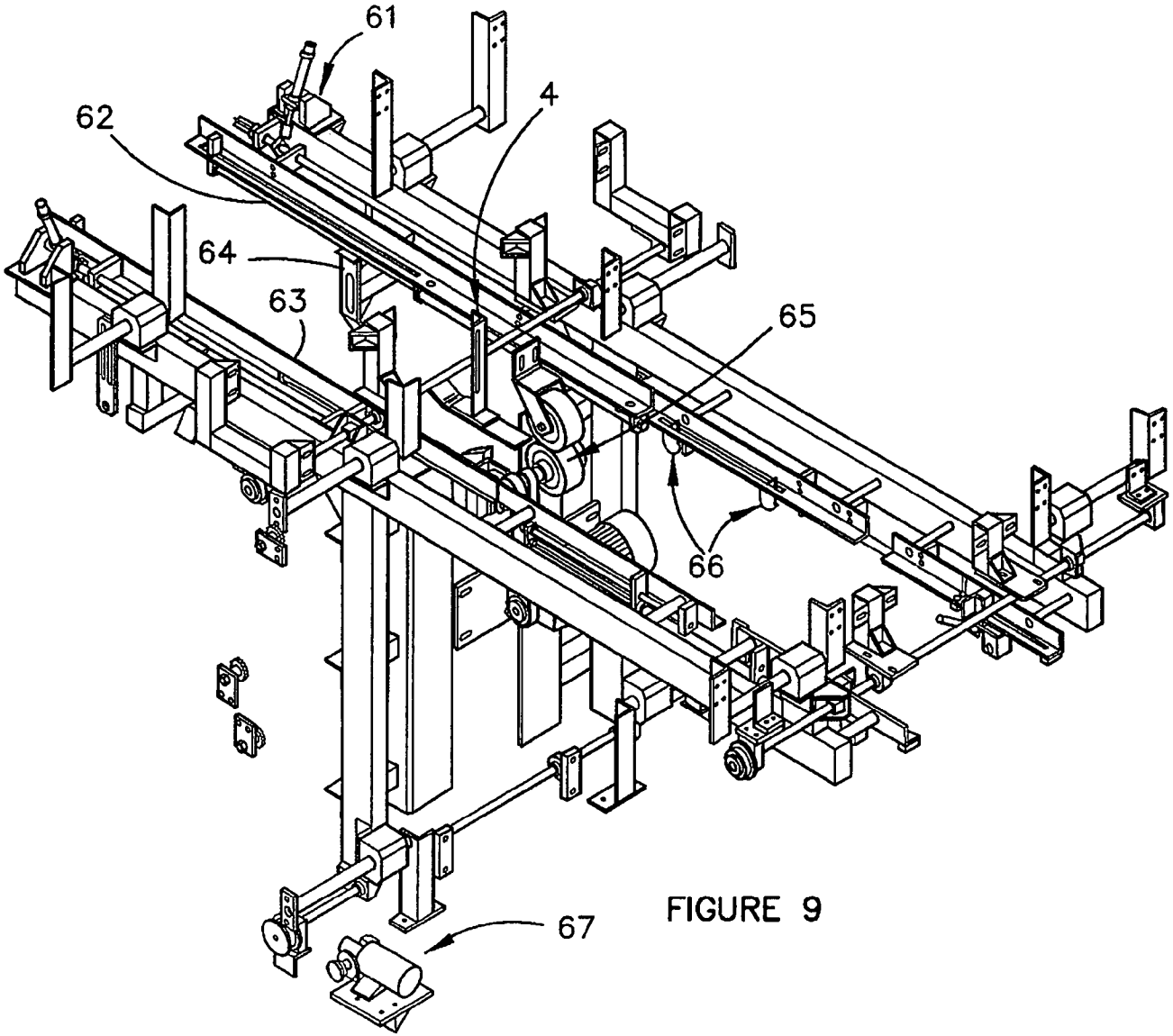
FIG. 9 is an isometric view of the variable blank transfer rails.

Referring to FIG. 9 of the drawings, the transfer and size change rails 4 are shown in greater detail. This section of the machine has a two-fold purpose. Firstly the mechanism moves the blanks through the machine from the magazine 3 into the forming area 5. When the vacuum pick-up 3*a* detects a blank to be picked up, the rail cylinders 61 extend the rails 62,63 to the open position so that the blank can be picked up. Once the blank is raised, the rails close to the spacing required for the particular blank and the blank is dropped. Magazine blank kickers 64 then push the blank to a set of nip rollers 65 which drive the board through the machine, at which time glue is applied to appropriate positions on the blank in the glue applicator section G, which includes glue applicators of known form and operation. The blank is then pushed by mandrel blank kickers 66 into the forming well 6. When the blank is in its correct position against the blank end stops E, the kicker 66 acts as a one-way dog to ensure that the blank is correctly positioned over the well 6.

The second major function of the rails is size change, and since the machine is capable of forming a range of different tray sizes, the rails 62,63 must be able to adjust in order to accommodate each specific blank size. To this end, the rail 62,63 move in and out on a series of threaded shafts as illustrated in the drawing, which are driven by a rail size change motor 67. The size change is effected according to pre-programmed settings at the same time as the well and mandrel settings are changed to suit the blank to be erected. When the blank is delivered to the forming well region 5, two secondary pneumatic cylinders (not shown) ensure that the blank is in the correct position against the blank end stops E. Reed switches on the extend sides of the pneumatic cylinders and a "box in position" photoelectric cell (not shown) will confirm the blank position. At this point the mandrel will actuate and the tray will be formed. The tray will be held in the forming well until such time as the next tray is formed and this tray will eject the presetting tray onto the conveyor 8 which carries the completed tray away.

It will be appreciated from the above that by providing a variable well 6 and a variable mandrel 7, numerous blank footprint sizes are able to be erected by a single machine thereby reducing the cost and speeding the erection of different sized blanks.

The invention claimed is:

1. A machine for erecting open topped cartons or trays from a substantially flat blank of varying footprint dimensions, comprising:

a magazine adapted to store a supply of flat blanks of predetermined dimensions;

means for delivering a flat blank from the magazine to a tray forming section; and said tray forming section including:

an adjustable well defined by wall portions which are movable in two directions to adjust the size of the well to match footprint dimensions of the flat blank, a mandrel having portions which are moveable in two directions to adjust the size of the mandrel to match footprint dimensions of the flat blank, and drive means for pushing the mandrel into the well to fold the flat blank into a tray.

2. The machine of claim 1, wherein the wall portions defining the well and the portions defining the mandrel include connected wall elements which define the corners of the well and the corners of the mandrel, said elements being moveable towards and away from each other to vary the dimensions of the well and the mandrel to suit blanks of various footprint dimensions.

3. The machine of claim 1 or claim 2, wherein the wall elements defining the well include plate members assembled to define a corner of the well, the plate members having upper edges which are rolled outwardly to allow the flat blank to be pushed into the well by the mandrel, the wall elements defining the mandrel comprising plates formed from or coated with low friction material such as nylon.

4. The machine of claim 3, wherein the well corner elements are adjusted by screw driven means while the mandrel wall elements are adjusted by pneumatic cylinder means.

5. The machine of claim 1 or 2, wherein the means for delivering blanks to the tray forming section include a pair of blanks supported rails which are adjustable towards and away from each other to suit flat blanks of various dimensions.

6. The machine of claim 5, wherein the means for delivering blanks includes blank kickers for moving the blanks from the magazine, pinch rolls for moving the flat blanks towards the tray forming section and blank kickers for moving the flat blanks to the tray forming section.

7. The machine of claim 1 or claim 2, wherein the magazine includes a support for a stack of blanks which is vertically moveable towards a vacuum transfer means which transfers flat blanks one at a time from the stack to the means for delivering blanks.

8. The machine of claim 1 or 2, further including blank end stops which are adjustable in position to ensure that flat blanks of various sizes are correctly positioned over the well.

* * * * *